US006598532B2

(12) United States Patent
Gerard et al.

(10) Patent No.: US 6,598,532 B2
(45) Date of Patent: Jul. 29, 2003

(54) ELECTRIC CIRCUIT FOR AN ELECTRICALLY DISCHARGEABLE PRIMER

(76) Inventors: Donald G. Gerard, 2720 Birch Tree Dr., St. Charles, MO (US) 63301; Eileen L. Gerard, deceased, late of St. Charles, MO (US), by Donald G. Gerard, executor ( * ) Notice: Subject to any disclaimer, the term of this patent is extended or adjusted under 35 U.S.C. 154(b) by 0 days.

(21) Appl. No.: 09/929,481

(22) Filed: Aug. 14, 2001

(65) Prior Publication Data

US 2003/0033951 A1 Feb. 20, 2003

(51) Int. Cl.[7] ..... F42B 3/10; F42B 3/12; F42C 11/00; F42C 19/12; F42C 19/10; C06C 7/00

(52) U.S. Cl. ..... 102/202.5; 102/202.7; 102/202.9; 102/202.14; 102/204

(58) Field of Search ..... 102/202.5, 202.9, 102/202.14

(56) References Cited

U.S. PATENT DOCUMENTS

| | | | | | |
|---|---|---|---|---|---|
| 1,034,160 | A | | 7/1912 | Starkweather | |
| 1,468,822 | A | | 9/1923 | Ludorf | |
| 2,188,760 | A | | 1/1940 | Richardson | |
| 2,423,837 | A | | 7/1947 | Martin | |
| 3,563,178 | A | | 2/1971 | Capces | |
| 3,577,923 | A | | 5/1971 | Perkins | |
| 3,768,413 | A | * | 10/1973 | Ramsay | 102/46 |
| 3,771,454 | A | | 11/1973 | White et al. | |
| 3,844,216 | A | * | 10/1974 | Jakobs et al. | 102/46 |
| 4,014,264 | A | * | 3/1977 | Bendler et al. | 102/46 |
| 4,267,567 | A | * | 5/1981 | Nygaard et al. | 362/46 |
| 4,386,567 | A | * | 6/1983 | Ciccone et al. | 102/202.5 |
| 4,715,280 | A | * | 12/1987 | Wittwer | 102/202.8 |
| 4,881,463 | A | * | 11/1989 | Ninio et al. | 102/202.2 |
| 5,044,278 | A | | 9/1991 | Campbell | |
| 5,485,786 | A | | 1/1996 | Hesse et al. | |
| 6,487,972 | B1 | * | 12/2002 | Cook et al. | 102/202.8 |

FOREIGN PATENT DOCUMENTS

| | | | | |
|---|---|---|---|---|
| DE | 23 64 272 | | 6/1975 | |
| EP | 0 520 360 | A1 * | 12/1992 | 102/202.5 |
| JP | 05133699 | * | 5/1993 | 102/202.7 |
| WO | 93/04337 | * | 3/1993 | 102/202.5 |

* cited by examiner

*Primary Examiner*—Michael J. Carone
*Assistant Examiner*—H. A. Blackner
(74) *Attorney, Agent, or Firm*—Richard J. Grundstrom

(57) ABSTRACT

An electrical circuit for electrically dischargeable primers having a conductive body, a first electrical contact area, a bottom plate area, one or more burn out area(s) on the bottom plate area, and a second electrical contact area. The conductive body provides an electrical path between a primer's inside cylindrical wall and an inside surface of the primer's cap or cup. The first electrical contact area makes an electrical contact with the inside surface of the cylindrical wall. The second electrical contact area makes an electrical contact with an inside surface of the primer's cap or cup. The bottom plate area is positioned in a bottom location of an electrically dischargeable primer. At least one, but typically two or more burn out areas are on the bottom plate area. The burn out areas have a reduced cross section area. The total cross section area of the burn out areas must be less than the cross section of any other location on the elongated conductive body. Since the burn out area have a smaller cross section area they will heat and burn faster than any other area when an electrical current is applied. This assures the precise location of ignition of primer powder.

7 Claims, 12 Drawing Sheets

B - B

"PRIOR ART"

B - B

A - A

C - C

D - D

F - F

ELECTRIC CIRCUIT FOR AN ELECTRICALLY DISCHARGEABLE PRIMER

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

This invention relates to an electrical circuit for an electrically dischargeable primer and more particularly to a type of electrical circuit that can be used in either a purely electrically discharged primer, or a dual or combination electrically and/or mechanically discharged primer.

Typical ammunition for most firearms of the past is discharged through an impact of a mechanical firing pin or similar object on a cartridge's primer. The impact causes a spark, within the primer, to ignite primer powder that in turn ignites gun powder contained within the cartridge casing. These typically involve an anvil of some sort and a foil which interacts with each other when the firing pin impacts the end of the primer. The rapid burn of the gunpowder within the cartridge casing creates the explosive force that propels the bullet from the cartridge and from the barrel of the firearm.

New firearms are being introduced that are electrically discharged. Rather than primers discharged by an impact from a mechanical firing pin, they require a primer that can be discharged by an electrical current. Standard ammunition using a percussion type primer will not work with an electrically discharged weapon and vice versa, purely electrically discharged primers will not work with a mechanical firing pin. As such, two different types of primers are now required, one electrically discharged and one impact or percussion discharged.

The majority of electrically dischargeable primers, known in the art, contain a wire filament. The filament is heated by an electrical current. The heated wire filament heats, burns and melts to ignite primer powder. The primer powder then in turn ignites the gun powder in the shell casing.

There is also known in the art conductive primer powders. These conductive powders are ignited by an electrical current going through the powder. These types of primers are not currently widely used.

The electrical circuit of this invention, in one preferred embodiment, can be used with a purely electrically discharged primer. In another embodiment, a dual dischargeable primer using the electrical circuit of this invention can be discharged by either an electrical current or a mechanical firing pin. The primary advantage to such an invention, is that a single primer can be used in all cartridges. As such, all cartridges of a particular caliber and size could be made interchangeable between electrically discharged and percussion discharged firearms. This would eliminate the need to maintain inventories for two different cartridge types, and would prevent the possibility of inserting an electrically discharged cartridge into a percussion type firearm and vice versa.

One primer of the past has an electrically conductive powder that required at least 180 volts to fire. This primer was also a dual dischargeable primer. It contained a second type powder that used a mechanical sliding member within the primer to create a spark by friction. Typically, these were designed for military type weapons such as the Navy 20 MM guns, large cannons or mortar type cartridges which can have a large electrical source attached thereto or located nearby. As such, they were never available for modern hand-held firearms. The primers were generally considerably larger to accommodate the dual components, but since they were for large guns, size was not a problem.

More commonly known, the electrically discharged primers use a wire filament. The wire, by necessity, is very small in diameter. The wire must be connected within the primer, and then the primer powder, and perhaps percussion elements, have to be added. There are a large percentage of malfunctions with this design. The small diameter wire often breaks during manufacturing, during installation of the primer powder or the percussion components, or the electrical connection fails for one reason or another. Additionally, there is no control as to where the wire would ignite the primer powder. Ignition could begin at one end, the other end of the wire, or perhaps in the middle some place. There was no consistency, no control.

As modern firearms progress, the location of ignition within the primer can be a factor in the overall performance of the firearm. Therefore, it is highly desirable to have an electrically discharged primer in which the location of the ignition of the primer powder can be controlled for consistency and reliability. Further, it is also very desirable to have an electrically dischargeable primer that is highly reliable, with few if any malfunctions.

Other problems encountered, with the primers of the past, was the complication of manufacturing. Especially, if the primers are made in a dual dischargeable configuration. Many had several components with a complicated interaction. It was very difficult to produce these primers in a cost effective manner. Since most of the dual dischargeable and electrically dischargeable primers were for military applications cost was not one of the primary considerations. They were never widely produced nor available for the general public, nor available for small caliber firearms. Now electrically discharged firearms are being introduced and there is a bigger demand for electrically discharged primers, and especially a primer made with an electrical circuit introduced by this invention.

Additionally, in almost all instances the electrical wire within the primers had to be electrically insulated from other components. Most of these components are very small and during manufacturing they are all pressed or installed within the primer cup. During construction, the electrical wire would often be electrically shorted to other parts or components. A short circuit rendered the primer, and the cartridge thereto, useless and would result in a malfunction or misfire. The electric circuit of this invention is highly reliable and very easily insulated even during the manufacturing process.

In these times, as in the past, a large number of persons reload their casing to save money and for enjoyment. Many of the electrically dischargeable primers of the past could not be installed by an individual, nor were they accepted into the existing shell casings. There had to be special casing or they were integrated with a cartridge casing. The primer using the electric circuit of the present invention is completely interchangeable with the primer as currently used in most ammunition. As such, the primer of this invention can be used by an individual using equipment and supplies at hand and existing shell casings can be used.

As such, an objective of this invention is to provide an electrical circuit for electrically dischargeable primer that can be universally used with all ammunition, for firearms that utilize either an electrically discharged system or firearms that utilize a mechanical firing pin for percussion type discharge. Typical ammunition is discharged with a percussion device, where an impact causes a spark to ignite the powder in the cartridge, which is purely mechanical. Whereas, electrically discharged ammunition requires an electrical current to ignite the powder in the cartridge. The electrical circuit for electrically dischargeable primer of this invention addresses both of these needs.

An additional objective of this invention is to provide an electrical circuit for electrically dischargeable primer, and cartridge thereto, that is interchangeable between firearms of the same caliber and that would work in either an electrically discharged or a standard firearm requiring standard percussion type action.

Yet another objective of this invention is to provide an electrically dischargeable primer that uses only one type of primer powder. A cartridge using only one type of powder is generally cheaper to build, because it is simple in design. A single powder primer, in a dual dischargeable primer, is generally more reliable than a primer having two different types of powders and which requires two different types of structures with the primer for ignition. This eliminates the need for having two types of powder with the primer. This invention eliminates the need for electrically conductive primer powder and provides a means of igniting any of the known primer powders on the market. There is no need of a special primer powder that is especially formulated for ignition by a heated wire filament and another powder for ignition by percussion.

Still another object of this invention is to provide an electrical circuit for electrically dischargeable primers that can be readily incorporated into dual dischargeable primers, to create primers that are highly reliable, providing a primer with very specific burn out locations to control the point of ignition, and that can be easily manufactured in mass to reduce the cost and to compete economically with existing primers on the market. It has been found that a primer made in accordance with this invention is cost comparable to primers currently being manufactured. There are few components which are easily assembled, less likelihood of shorting the components, a higher reliability of firing, and all the components are readily installed in an assembly operation similar to current primers.

Another object of this invention is to provide a primer that is highly reliable and has few, if any, malfunctions when electrically discharged. In accordance with the features of this invention, it has been found there is no breakage of a wire within the primer which created a high number of malfunctions. In addition, the design of this invention creates electrical connections which are more reliable than electrical connection of wires within a primer casing. Additionally, the components are such that there is little likelihood of creating an inadvertent short during assembly and manufacture. As such, an electrically dischargeable primer made with the electrical circuit of this invention is very reliable and cost effective.

Another object of the electrical circuit for electrically dischargeable primers is to create an electrical dischargeable primer that can be completely interchangeable with existing primers. The primer made with the electric circuit of this invention can be installed in existing shell casing in place of standard primers used in the art. As such, primers made using the electrical circuit of this invention are completely interchangeable with currently used cartridges.

BRIEF SUMMARY OF THE INVENTION

The electrical circuit for electrically dischargeable primers of this invention basically consists of an elongated conductive material having a first electrical contact, a bottom plate area, one or more burn out area(s) on the bottom plate area, and a second electrical contact. It can be made with a conductive metal strip or foil, or with a conductive material such as (but not limited to) conductive paint or any conductive liquids which can be dried.

Typically in the embodiments presented herein, the electrical circuit provides a short circuit between the inside bottom surface of a primer cup and the inside surface of the primer cylinder wall. The bottom of the cup must be electrically insulated from the cylinder walls of the primer. The first electrical contact is in electrical contact with the inside surface of the cylinder wall of the primer. The second electrical contact is in electrical contact with the inside bottom surface of the primer cup. The bottom plate area is between the first and second electrical contacts and is positioned in a lower position within the cup. The bottom plate area of the electric circuit has at least one specifically defined burnout area to control the location of the burn and therefore the ignition of the primer powder when an electrical current is applied. The burn out area, or areas, must have a total cross section area smaller than any other cross section area on the electrical circuit. The smaller cross section area of the burn out area allows for a precise location for the electrical circuit to burn and ignite the primer powder. Primer powder is added over the bottom plate with the burnout area within the cup for ignition by the electrical circuit.

Since the bottom plate area of the electric circuit, in the prefered embodiment, is positioned at a bottom location within the primer, there is little likelihood of creating an inadvertent short and virtually no likelihood of breakage.

The electric circuit can be used for either a purely electrically dischargeable primer or it can be used in a dual dischargeable primer in which the primer can be discharged either electrically or mechanically.

The above mentioned and other objects and features of the present invention will be better understood and appreciated from the following detailed description of the main embodiments thereof, selected for purposes of illustration and shown in the accompanying drawings.

DETAILED DESCRIPTION OF THE INVENTION

Figure 1:
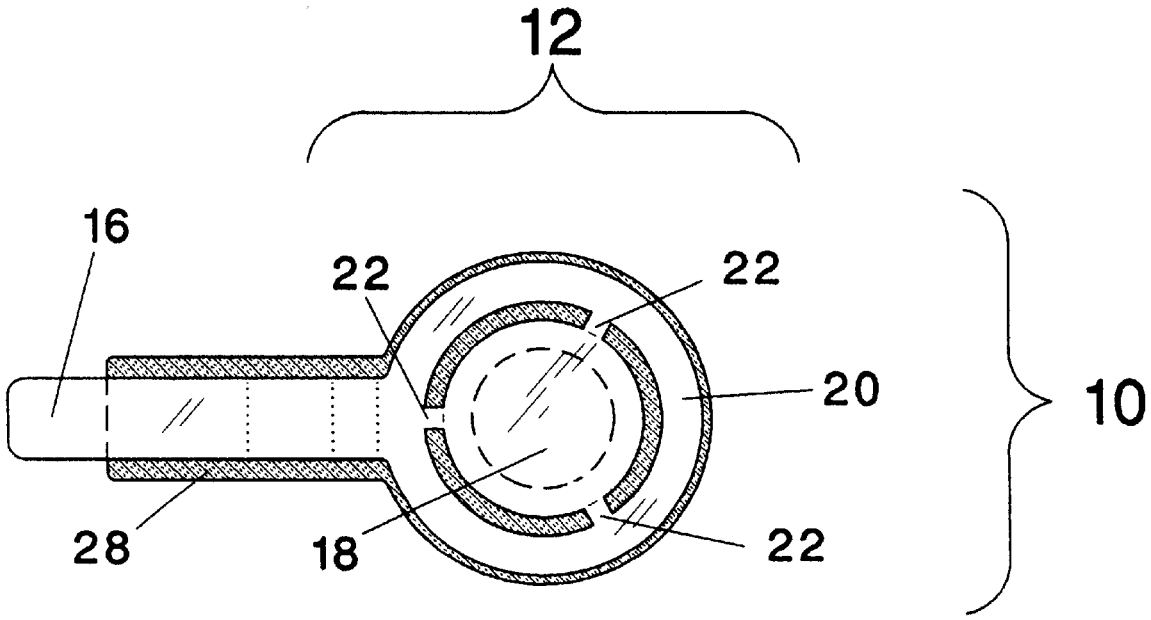
FIG. 1 shows one embodiment of the electrical circuit of this invention, showing the electrical circuit in a flattened pattern to provide a representational view showing the relationship of the burn out area in relation to the remainder of the electric circuit. The electrical circuit of this embodiment is used in the primers shown in FIGS. 5–8.

Referring now to the drawings in general there is shown the preferred embodiments, and the best mode contemplated, of the electrical circuit 10 for an electrical dischargeable primer 14.

Figure 2:
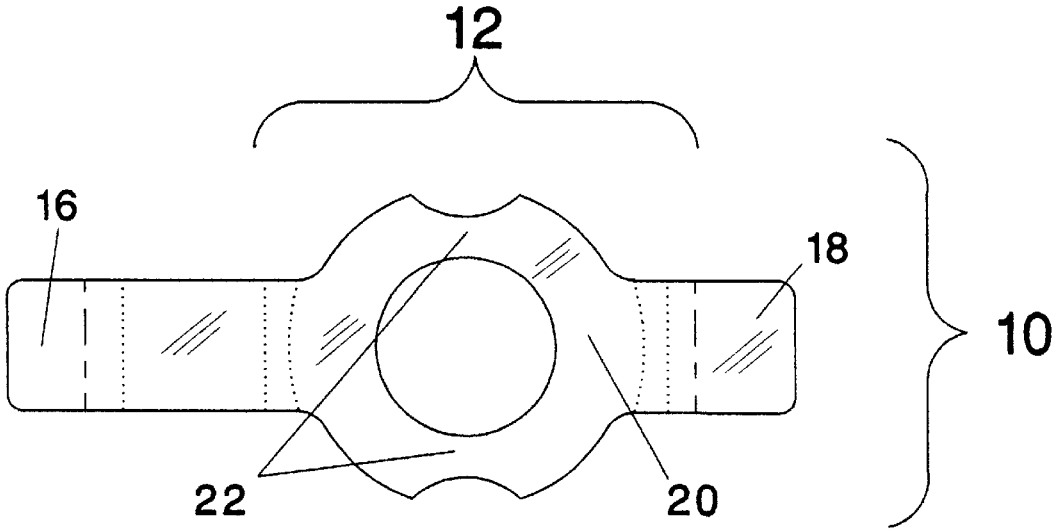
FIG. 2 shows a second embodiment of the electrical circuit of this invention, showing the electric circuit in a flattened position to provide a representational view showing the relationship of the burn out area in relation to the remainder of the electric circuit. The electric circuit of this embodiment is used in the primers shown in FIGS. 9–12.
Figure 2A:
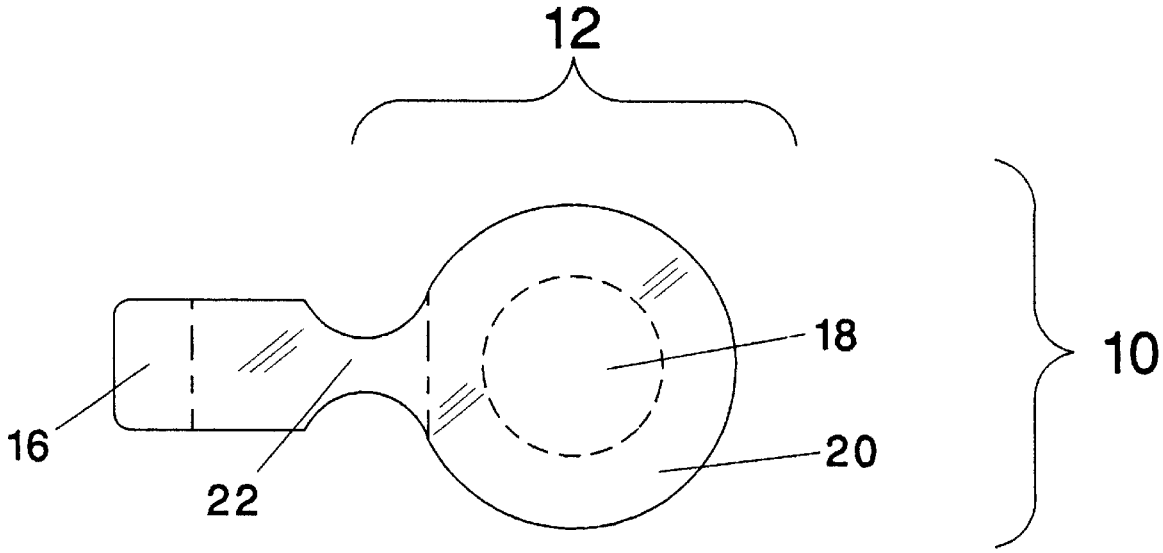
FIG. 2A shows a third embodiment of the electrical circuit of this invention, a variation of the electrical circuit shown in FIG. 2, with a simple burn out area, as used in the primer shown in FIG. 3.

FIGS. 1, 2 and 2A show three basic configurations of the preferred embodiments of the electrical circuit 10, which are in a flattened view to illustrate the principal features of the invention. Other configuration could also be used that could also contain the main inventive features of the invention. These configurations are illustrated by way of example and not as a limiting factor.

The electrical circuit 10 of this invention has an elongated conductive body 12, a first electrical contact area 16, a bottom plate area 20, one or more burn out area(s) 22 on the bottom plate area 20, and a second electrical contact area 18. Further detail is provided below.

DESCRIPTION OF THE PRIOR ART

The most common primer currently known and used in most modern firearms is a percussion type primer There are two basic types of percussion primers for modern cartridges. One is a Berdan type primer. In this type primer, the casing or primer cup also functions as the anvil. As the firing pin strikes the rear of the primer, a spark is created by sharp particles in the primer powder mixture interacting with the casing and foil.

Figure 4:
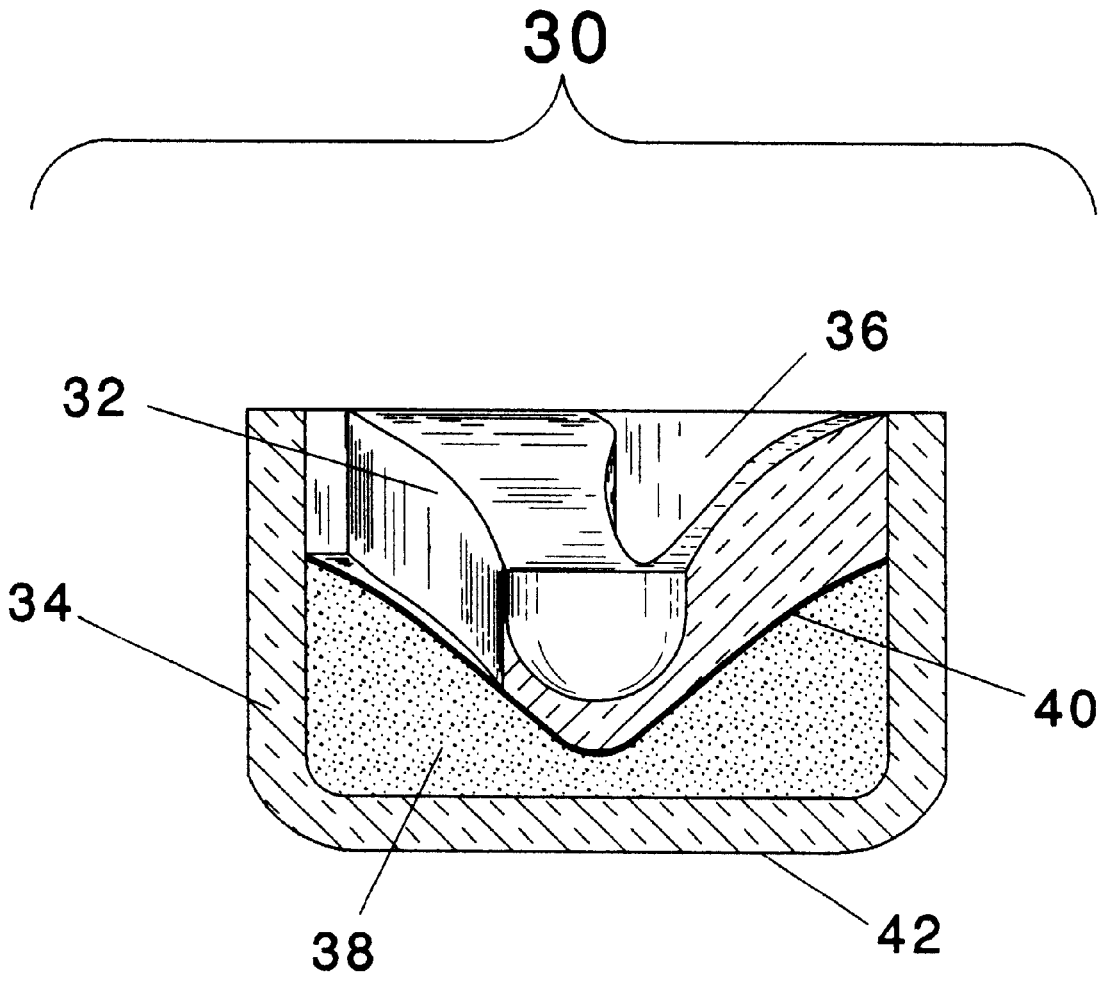
FIG. 4 shows a sectional view of a typical percussion discharged primer, showing the relationship of an anvil, foil and primer powder within a primer cup.

The most common type of percussion primer used, at least in the United States, is known as a Boxer primer 30, a typical representation of this type of primer is illustrated in FIG. 4. This type of primer utilizes a separate anvil 32 installed in the top of a primer cup 34. There are one or more flash holes 36 located in the anvil 32. The flash or burn of the priming mixture or powder 38 passes holes 36 in anvil 32 to ignite the gun powder in the shell casing. As the firing pin strikes the primer, particles within the primer powder 38, and the foil 40 impact against the anvil 32. This interaction creates a spark to ignite the mixture or primer powder 38. This in turn ignites the gun powder in the cartridge casing.

In a percussion discharge, typically a firing pin, or similar object in the firearm, strikes the bottom surface 42 on the primer cup 34. This causes a rapid indentation of the bottom surface 42. It is the rapid formation of the indentation that forces the powder 38 and foil 40 to deflect and strike the anvil 32 causing ignition.

DESCRIPTION OF THE PREFERRED EMBODIMENTS

The electrical circuit 10 of this invention can be made with any conductive material that can create a short circuit and having enough resistance to cause the burnout area 22 of electrical circuit 10 to be heated, enough to ignite primer powder 38, with a low current. The electrical circuit 10 can be made with thin conductive metal strip or foil in a general pattern shown in FIGS. 1, 2, and 2A. In another embodiment, it can also be made with a conductive paint or liquid applied in an etching within the primer, or it can be made with a conductive material in a process similar to making integrated circuits or electroplating.

The first electrical contact area 16 is an area on the electrical circuit 10 that is typically used for an electrical contact with an inside surface of a primer's cylindrical wall area 24. The first electrical contact area 16 extends from the bottom plate area 20 to make the electrical contact with an inside surface of cylinder wall area 24.

The electrical connection, between the first electrical contact area 16 and the inside surface of the primer cylindrical wall, can be as simple as a direct surface to surface contact with nothing but direct contact. The electrical contact, between the electrical contact area 16 and the inside surface of the primer's cylindrical wall area 24, can also be electrically fastened or secured with conductive adhesives, welding, soldering, or by some other low resistance means that will not burn or over heat prior to the defined burn out areas 22. The electrical contact is not limited to these examples. These are only provided as examples and as the best modes contemplated.

If the electrical circuit 10 is made with a conductive material such as conductive paint, conductive liquid, or made with a process similar to integrated circuits or electroplating, the electrical contact between the first electrical contact area 16 and inside surface of the primer's cylindrical wall area 24 will be made at the same time as the formation of the electrical circuit 10. Typically, but not necessarily, if the electric circuit 10 is made in one of these manners, the configuration shown in FIG. 2 or 2A, or similar configurations, would be used.

To make an electrical circuit 10 using a conductive paint, conductive liquid, or by electric platting as with an integrated circuit, a pattern similar to that shown in FIG. 2 would be etched or carved out inside of the primer 14. The etching of the insulator can be acidly etched or physically cutout in the desired pattern, as best determined by the material to be applied, but not through to the metal except where areas 16 and 18 of circuit 10 make connection to the primer 14. Once the pattern is formed, the conductive paint or conductive liquid is applied in the pattern. The electrical circuit could also be electrically plated into the etched pattern or deposited using ink jet printer technology. These processes form the electrical circuit 10 and makes all electrical contacts within the primer 14 simultaneously.

The electrical circuit 10 has a defined area in the elongated body 12 called a bottom plate area 20. This area is typically an area of the elongated body 12 that bulges or has some deformation from the elongated body 12 that stands out and specifically identifies the area. As the name implies, the bottom plate area 20, in a preferred location and for the most reliable ignition of the primer powder 38, is positioned in a lower or bottom area within primer 14. In this location, the bottom plate area 20 will be completely covered by primer powder 38. The bottom plate area 20, and the portion of the elongated body 12 between the first electrical contact area 16 and the bottom plate area 20, is electrically insulated from the bottom of the primer and from the inside of the cylinder wall by an insulator 28 or 66.

Figure 5:
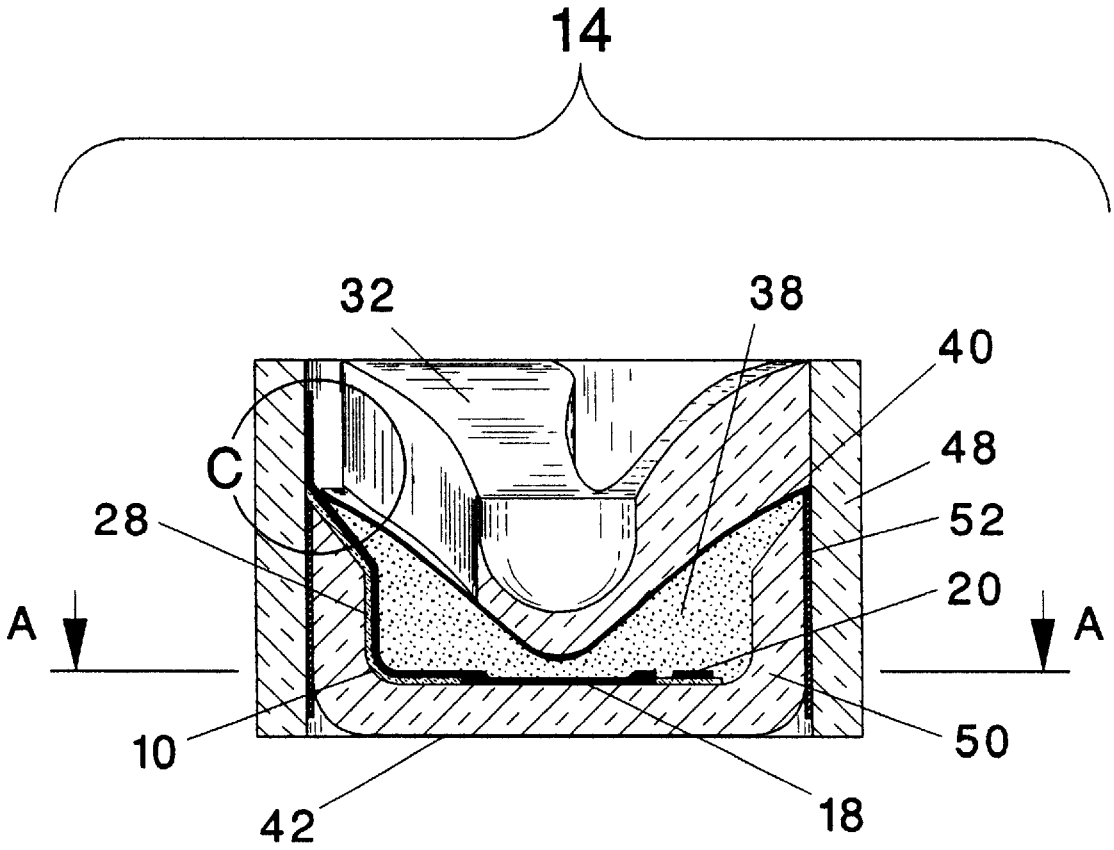
FIG. 5 is a sectional view showing the components of a dual dischargeable primer using the electric circuit of this invention shown in FIG. 1, which is capable of discharge either electrically or by percussion.
Figure 9:
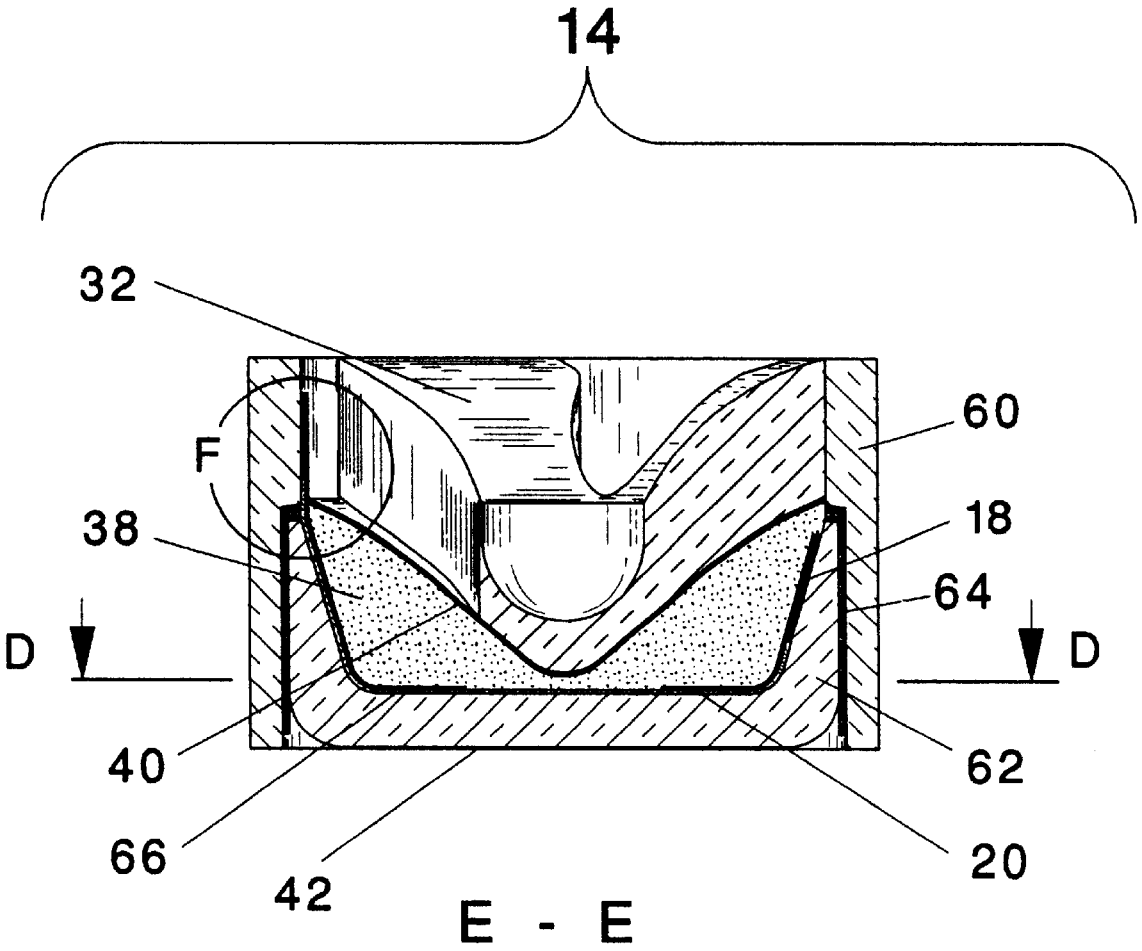
FIG. 9 is a sectional view showing the components of a second embodiment using the second embodiment of the electric circuit of this invention, shown in FIG. 2, used in a dual dischargeable primer which is capable of being discharged either electrically or by percussion.

A second electrical contact 18 area makes an electrical contact to the bottom inside surface of a cup or cap 26. The second electrical contact area provides an electrical path from the bottom plate area 20 to the inside surface of the cap or cup 26. The second electrical contact area 18 can be an extension extending outwards from the bottom plate area, as shown in FIG. 2 and 9. In another embodiment, the second electrical contact area 18 extends downward from a center opening in the bottom plate area 20, as shown in FIG. 1 and 5.

As with the first electrical contact area 16, the second electrical contact area 18 can be a direct surface to surface contact with the inside surface of the cap or cup 26. The electrical contact, between the second electrical contact area 18 and the inside bottom surface of the primer's cup or cap 26, can also be electrically fastened or secured by conductive adhesives, welding, soldering, or by some other low resistance means that will not burn out before the defined burn out areas 22.

The cup or cap 26 is electrically insulated from and installed within a primer cylindrical wall 68, 48, and 60, depending on the embodiment. In this manner, as described above, the electric circuit 10 provides a direct and the only electrical path between the primer's cylindrical wall area 24 and cup or cap 26.

The specific feature that makes this invention work so well is the burn out area or areas 22 located on the bottom plate area 20. The burn out area or areas controls the specific area in which the primer powder 38 is ignited. The specific characteristic that make this possible is that the total burnout area 22 has a total cross section area less than any other cross section area on the electrical circuit 10. There can be as few as one single burnout area 22 or there can be multiple. The specific number is determined by the material being used, the process to create the electrical circuit 10 within the primer 14 and the desires of the manufacture. Since the burnout area 22 has a smaller cross section area than any other location, it will always burnout before any other area of the electrical circuit 10. As illustrated in FIG. 2, the burnout area 22 has two burnout areas configured in the form of indentations along the outside of a center opening to reduce the effective cross section area. FIG. 2A is similar to FIG. 2 but has one burnout area 22. Similarly, the circuit 10 in FIG. 1 has three burnout areas 22. These burn out areas 22 are thin conductive material used to connect the bottom plated area 20 to the second electrical contact area 18. As electrical current is applied, the electrical circuit 10 will heat in accordance with the amount of current and specific resistence of the conductive material. Since the cross section of the burn out area 22 is smaller, it will heat faster and be the first area to burn. In this manner the location of ignition is specifically controlled.

The controlled location of burnout areas 22 are positioned in the primer at a location that is least disturbed during installation of the primer 14 in the case. This location is also considered the optimum position for ignition. The primer powder 38 and the burnout area 22 create an interface region within the primer 14 where ignition will occur. It is highly unlikely that ignition could occur anyplace in the electrical circuit 10 but at one of the burn out areas 22.

Tests were run with electrical circuit 10 having one burn out area. These worked satisfactorily, but multiple burn out areas 22 are preferred to provide a back up against a single point failure.

The bottom plate area 20, burnout area 22 and the entire electrical circuit 10 can actually have any look or configuration as long as the principal features and characteristics are maintained. The illustrations herein are considered examples only, and as a preferred embodiments and best mode contemplated at the time of this application. Other configurations which function equivalently are within the scope and limitations of this invention.

DESCRIPTIONS OF THE BEST MODES CONTEMPLATED

Figure 3:
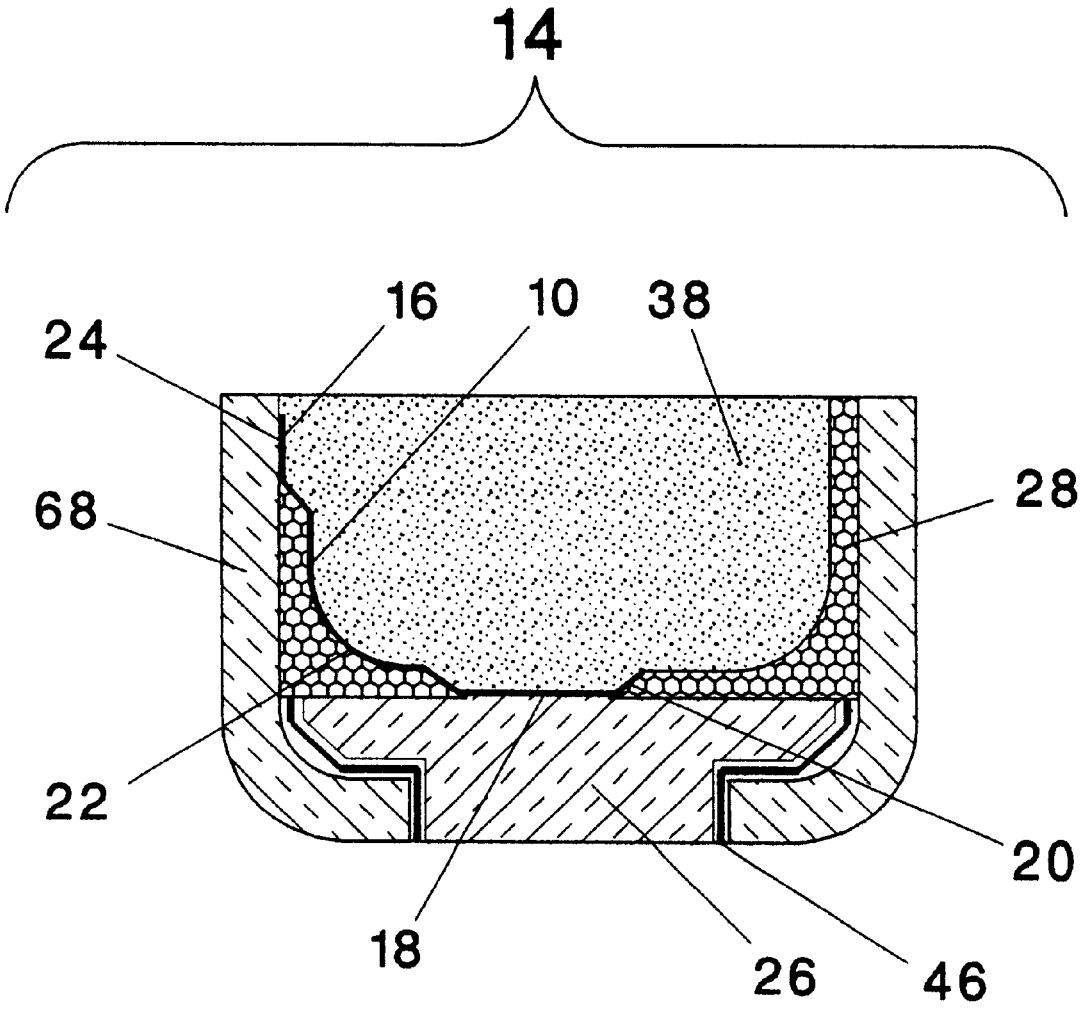
FIG. 3 shows a sectional view of a representation of a typical electrically discharged primer using an electrical circuit of this invention.

The first configuration of the best mode contemplated is purely an electrically discharged primer 14 as shown in FIG. 3. The primer 14 is constructed with a cylindrical wall 68 with a cap 26 installed in an end opening. The cap 26 is electrically insulated from the cylindrical wall 68 with an insulator 46. The electrical circuit 10 provides the only electrical path between the cylindrical wall 68 at area 24 and cap 26.

The electrical circuit 10 as illustrated in FIG. 2A is being used in this embodiment of the best mode contemplated. The first electrical contact area 16 is in electrical connection with the inside surface of the cylindrical wall 68 at area 24 and the second electrical contact area 18 is in electrical contact with the inside top surface of cap 26. The single burnout area 22 provides an electrical path between the bottom plate area 20, the cap 26, and the first contact area 16 at area 24 as described above.

When an electrical current is applied between the cylindrical wall 68 and the cap 26, the electrical circuit provides a short circuit. The current causes the electrical circuit 10 to heat, especially at the burn out area 22. When the burn out area 22 burns through, the powder 38 is ignited.

FIG. 5–8 illustrate a dual dischargeable primer that can be discharged by either an electrical current or percussion. This second embodiment of the best mode contemplated, uses a thin metal foil, in the configuration shown in FIG. 1, as the electrical circuit 10. In this embodiment, a cylinder 48 has a straight opening through the center of the cylinder 48. A cup 50 is installed within cylinder 48 with insulating material 52 electrically insulating the cup 50 from the inside surface of cylinder 48. The insulating material in the test primers 14 was made from nylon and "Instant Krazy Glue" made by Elmer's Products, Inc., but any insulating material that functions in this situation would be considered within the scope and limitations of this invention.

Figure 7:
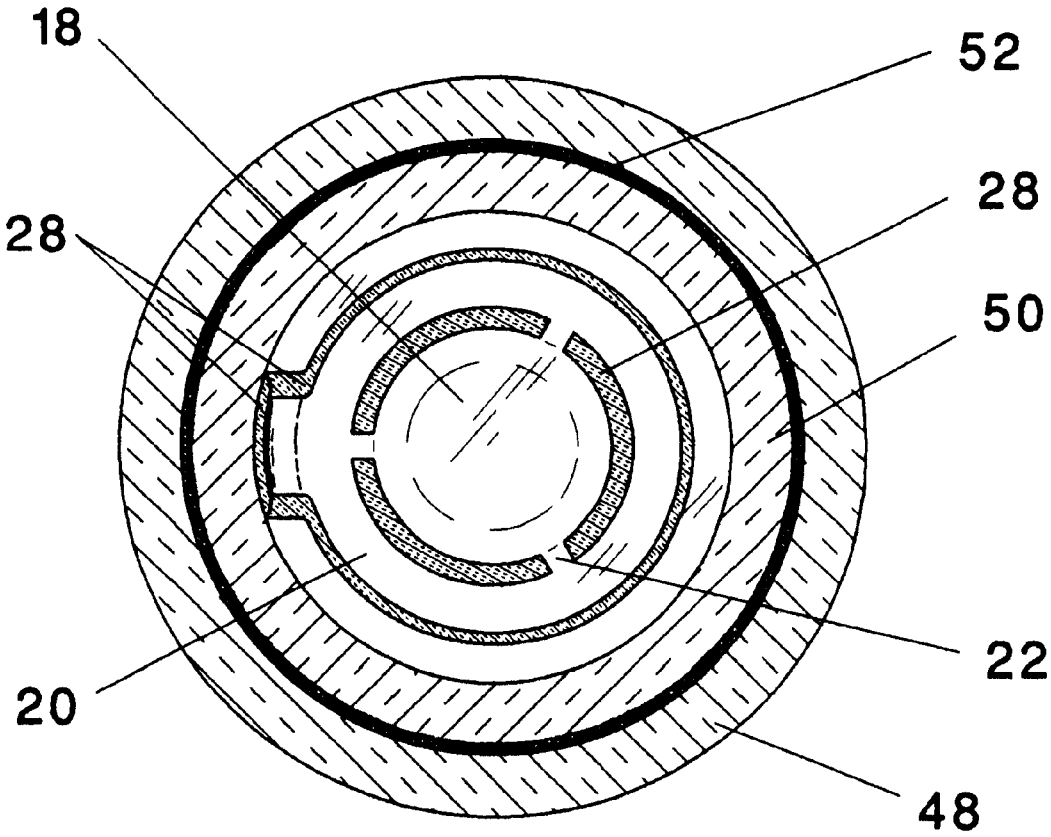
FIG. 7 is a cross sectional view taken from below the foil and above the bottom plate of the electrical circuit, A—A from FIG. 5.
Figure 8:
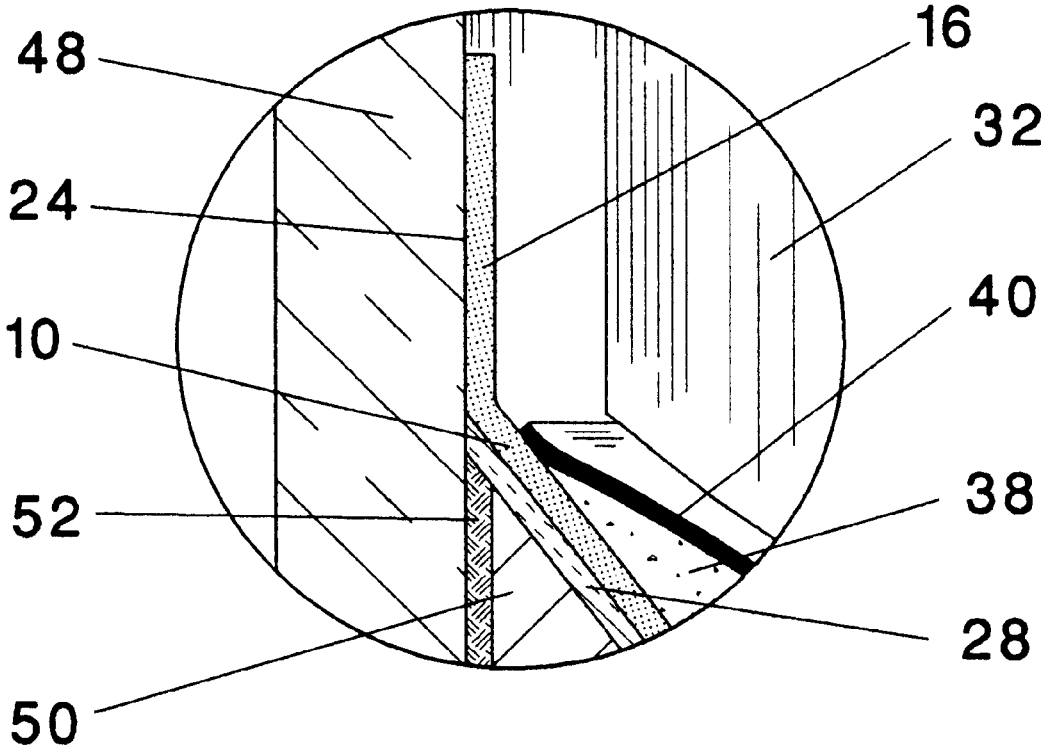
FIG. 8 is an enlarged view of area C from FIG. 5.

FIG. 7, a sectional view of A—A on FIG. 5, shows the bottom plate area 20 installed in the bottom of cup 50. The bottom plate area 20 is positioned in the bottom area of the primer and is insulated from the bottom of cup 50 by insulator 28, similar to that shown in FIG. 3. The first electrical contact area 16 is in electrical contact with the inside surface of cylinder 48 as better shown in FIG. 8. FIG. 8 is a blow up sectional view of C from FIG. 5. This contact can be by friction or in the preferred embodiment rigidly connected by welding. The principal feature is that there is a continuous and reliable electrical connection.

The second electrical connection area 18 is electrically connected through an opening in the insulator 28 to the inside bottom surface of cup 50. Again, the principal feature is that there is an electrical connection that is reliable. In the preferred embodiment, this connection is also soldered. The only areas of electrical conductivity or electrical connection between electrical circuit 10 and the primer 14 are at the first and second electrical contact areas 16 and 18 as specified. This is to ensure the flow of the electrical current and to control the burn out in the proper location.

Figure 6:
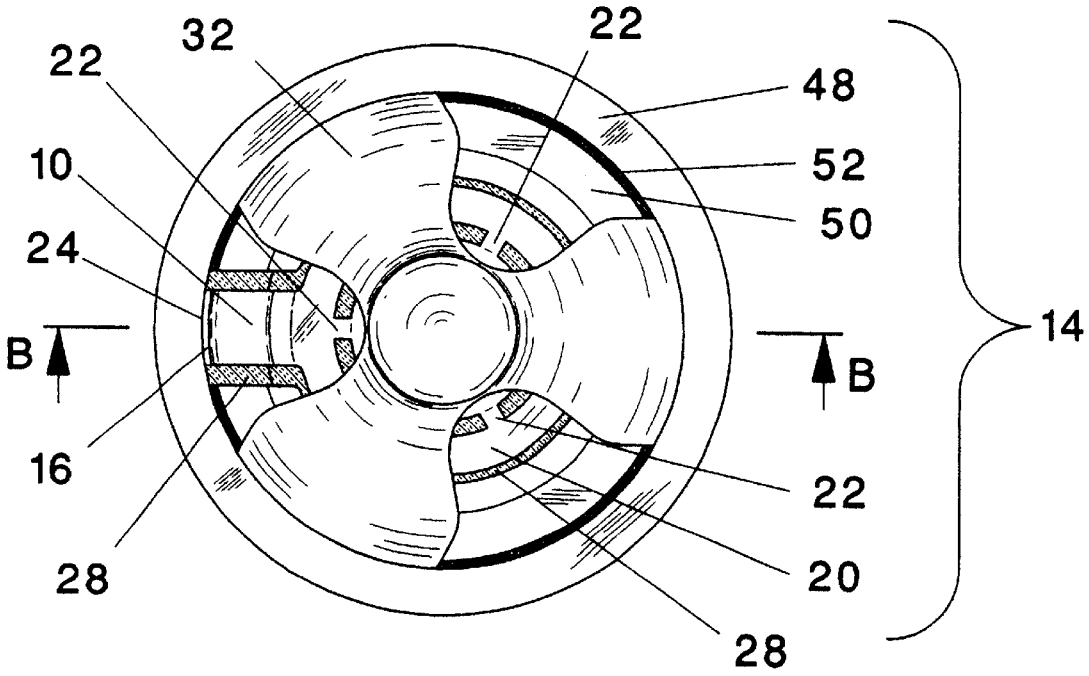
FIG. 6 is a top view of FIG. 5, without the foil and primer powder for clarity.

Once all the electrical connections are made, the primer powder 38 is installed over the bottom plate area 20. A foil 40 is installed over the primer powder 38, similar to what is already being done and as illustrated in FIG. 4. The anvil 32 is then inserted in the primer 14 above the foil 40. The anvil 32 and foil function as a standard Boxer type primer as shown in FIG. 4. A firing pin or other percussion device strikes the bottom surface 42 of the cup 50. This causes an indentation. The indentation causes the primer powder 38 and foil 40 to impact against the anvil 32. This impact causes ignition of the primer powder 38. FIG. 6 shows a top view of the embodiment shown in FIG. 5, without the primer powder 38 and foil 40.

FIGS. 9–12 illustrates a third embodiment of the best mode contemplated, which is made with a liquid insulating material and liquid conductive materials. The cylinder 60 has a two diameter opening through the cylinder. This creates an internal ridge which acts as a stop for cup 62 and provides a smooth transition for the first electrical contact area 16 of electrical circuit 10 to make an electrical contact with the inside surface of cylinder 60 at area 24. The cup 62 is electrically insulated from the cylinder 60 using an insulating layer 64. The insulating material 64 can be made from a non-conductive adhesive or other insulating material. The inside of the cup 62 and cylinder 60 assembly is coated with an insulator 66. This can be a spray of varnish or polyurethane, or any other insulating material that coats the inside surfaces. This creates insulator 66 as shown in FIGS. 9–12. A plastic layer could also be used. The surface of the coating is then etched or carved with a pattern similar to the pattern shown in FIG. 2. The insulating material 66 would be etched to the bare metal surface in the inside of cylinder 60 forming a contact point area 24 and to an inside surface of cup 62 to create points of electrical contact corresponding to the first and second electrical contact areas 16 and 18 in electrical circuit 10. The bottom plate area 20 with burn out areas 22 are etched into the bottom area of the primer, but not down to the bare metal. The bottom plate area must be insulated from the cup 62. A conductive liquid, such as a conductive paint or other conductive liquids which will dry, is applied within the pattern etched in the insulated material to create the electrical circuit 10. As the electrical circuit 10 is formed, all electrical contacts are made simultaneously. "Nickel Paint" by GC Electronics was used in testing the first prototype. Other types of paints, conductive sprays or liquids would also function. The pattern could also be filled with a type of electroplating.

Figure 10:
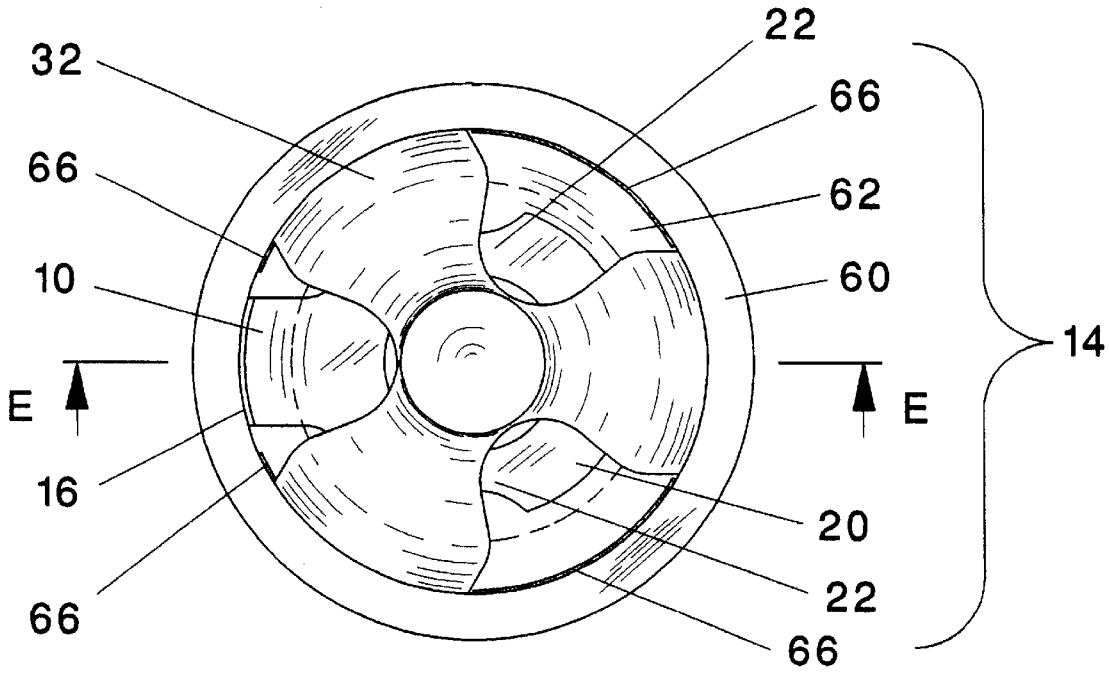
FIG. 10 is a top view of FIG. 9, without the primer powder and foil for clarity.
Figure 11:
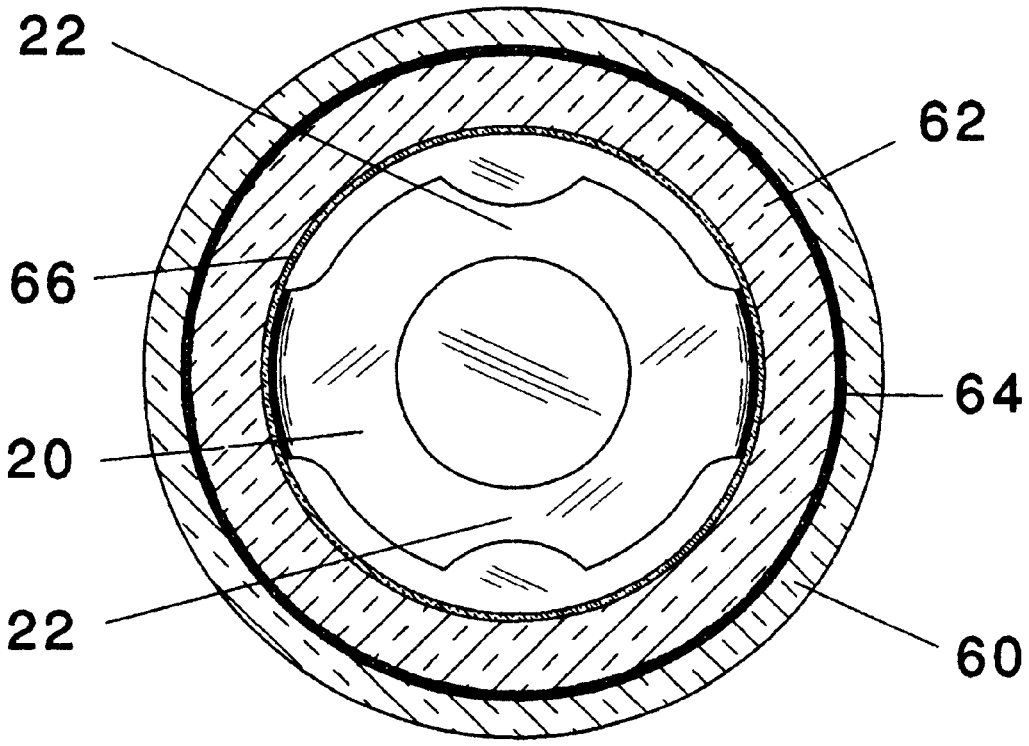
FIG. 11 is a cross sectional view taken from below the foil and above the bottom plate of the electrical circuit, D—D from FIG. 9.
Figure 12:
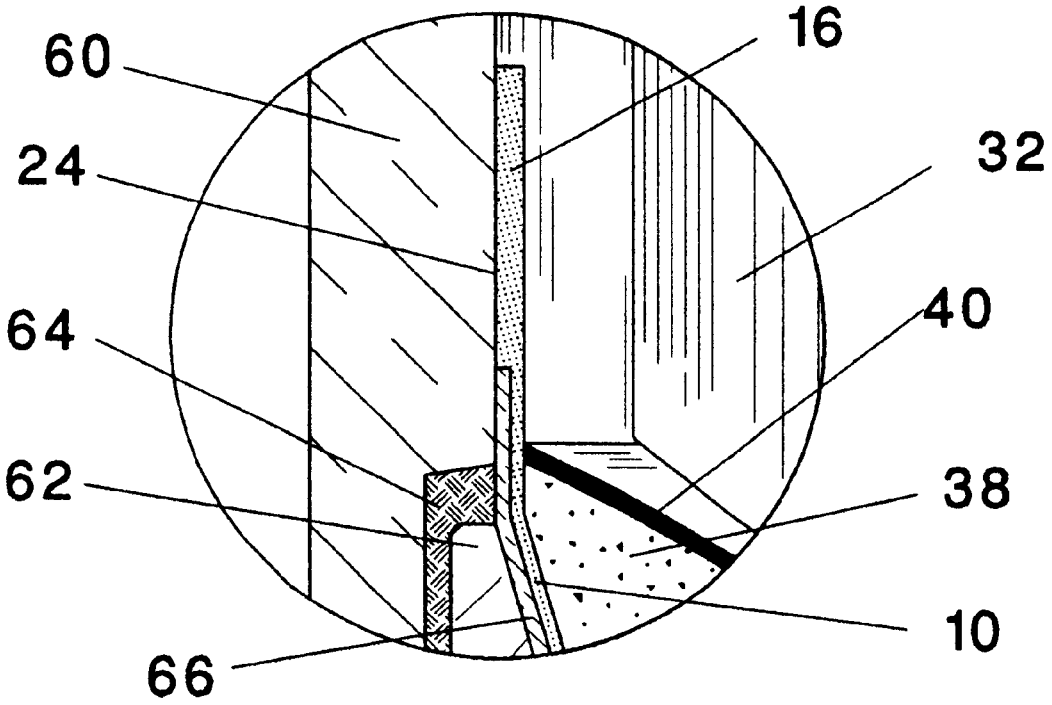
FIG. 12 is an enlarged view of area F in FIG. 9.

Once the electrical circuit 10 is made and dried, the primer powder 38 is installed over the bottom plate area 20. A foil 40 is installed over the primer powder 38, similar to what is already being done and as illustrated in FIG. 4. The anvil 32 is then inserted in the primer 14 above the foil 40. The anvil 32 and foil 40 function as a standard Boxer type primer as shown in FIG. 4. A firing pin or other percussion device strikes the bottom surface 42 of the cup 62. This causes an indentation. The indentation causes the primer powder 38 and foil 40 to impact against the anvil 32. This impact causes ignition of the primer powder 38. FIG. 10 shows a top view of the embodiment shown in FIG. 9, without the primer powder 38 and foil 40.

Since the dual dischargeable primer, made with the electric circuit 10 of this invention, 10 is completely interchangeable with standard primers, only one inventory of primers and only one inventory of ammunition would have to be maintained. Also, since the dual dischargeable primer functions by percussion or by electrical current, there is no likelihood of loading the wrong type ammunition into a firearm.

In these last two embodiments, various known adhesives, varnishes, and epoxies have been used and tested as the insulating materials 64, 66, 52, and 28. These types of materials are electrically non-conductive and have adhesive properties to securely hold the cup or cap within the cylinder. Any of these or any other known non-conductive material could be used without departing from the scope of this invention.

The primers 10 of this invention can be tested for conductivity, at various stages of assembly using common conductivity test equipment. This can be automated or done manually. Any short circuited assemblies would be rejected, and discarded or disassembled for later use.

The primary component that makes the electrical discharge possible, and distinct from other known electrical discharged primers, is the electrical circuit 10. The electrical circuit 10 is a conductive material that creates a short circuit between cylinder and the cup or cap. The electrical circuit 10 controls the point of ignition of the primer mixture or powder. Prior art generally had no control of the point of ignition. It was just some place along the electrical path. This resulted in many misfires, and a slow or lagging ignition, and often no ignition at all. The electrical circuit 10 of this invention overcomes these types of problems by providing a specific and controlled location for ignition.

The primer powder 38 is virtually any primer mixture already available, known, used or yet to be developed for use in standard percussion primers. The particular primer powder 38 would, of course, be selected by the particular manufacture based upon their desires and experiences. The most commonly used primer mixtures, which would in all likelihood are used as the primer powder 38, has a lead styphnate base. A lead free primer mixture having a base made from diazodinitrophenol is also used but is not readily available. The primer mixture also contains various amounts of initiators, oxidizers, frictionators and binders. The specific mixture content varies from manufacture to manufacture based upon desired characteristics. However, no specific mixture is required for the electric circuit 10 of this invention. Most, if not all, mixtures would function just as in a standard primer. A foil 40 is installed over the primer powder 38. The foil 40 is typical of any foil in standard percussion type primer. The foil 40 holds the powder 38 in position, provides a seal to protect the primer powder 38, prevents moisture from depleting characteristics of the powder 38, and helps to create and control the spark as the powder 38 and foil 40 impacts the anvil 32. The anvil 32 is installed into the top opening of the cylinder over the top of the foil 40. The anvil 32 is typical of any anvil used in a standard percussion type primer. The anvil 32 is typically pressed into position in the cylinder. The lower bottom end of the anvil 32 is in close proximity to the top of the foil. The distance between the two is small, such that as an indentation is formed by an impact of a firing pin against the bottom surface of the cup or cap, the foil 40 and powder 38 can impact the anvil 32.

The anvil 32 and foil 40 play no part in the electrical discharge of the primer. The only electrical consideration is that the anvil is pressed into the cylinder and there may be conductivity between the anvil 32 and cylinders 48 or 60, of the applicable embodiment. As such, the only consideration is to ensure there is no current path between the anvil 32 and electrical circuit 10, except current flow through burn out area(s) 22 and contact area 18.

The preferred embodiment and the best mode contemplated of the electrical circuit 10 for electrically dischargeable primer 14 of the present invention are herein described. However, it should be understood that the best modes for carrying out the invention hereinafter described are offered by way of illustration and not by the way of limitation. It is intended that the scope of the invention include all modifications which incorporate its principal design features and equivalent Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. An electrical circuit for an electrically dischargeable primer comprising said first and second electrical contacts extending upwardly from the bottom plate area:

a conductive body made from an electrically conductive material for providing an electrical path between an inside surface of an electrically dischargeable primer's cylindrical wall and an inside bottom surface of a an electrically dischargeable primer's cup or cap, said conductive body being the only electrical path between said cylindrical wall and said cap or cup;

a first electrical contact area being a first end of said conductive body, said first electrical contact area for making an electrical contact with an inside surface of a cylindrical wall of said electrically dischargeable primer;

a bottom plate area between said first end and a second end of said conductive body, said bottom plate area for placement within a bottom location within said electrically dischargeable primer;

one or more burn out area or areas on said bottom plate area, each of said burn out areas having a reduced cross sectional area with a total cross section area of all of said burn out areas less than any other cross sectional area of said conductive body and said bottom plate area; and a second electrical contact area extending from said bottom plate area, said second electrical contact area providing an electrical path for said electric circuit to a cap or cup of said electrically dischargeable primers;

said first and second electrical contacts extending upwardly from the bottom plate area.

2. The electrical circuit for an electrically dischargeable primers as set forth in claim 1 in which said conductive body is formed from a metallic electrically conductive material.

3. The electrical circuit for an electrically dischargeable primer as set forth in claim 1 in which said conductive body is formed from a conductive paint or liquid applied in an etching within said electrically dischargeable primer.

4. The electrical circuit for an electrically dischargeable primer as set forth in claim 1 in which said first and second electrical contact areas make an electrically conductive connection by either a friction electrical connection, welding, soldering, glueing with an electrically conductive adhesive, or by a chemical electrically conductive adhesion.

5. An electrical circuit for an electrically dischargeable primer comprising a cylindrical wall and a primer cup or cap, the electrical circuit comprising an elongated conductive material having a first electrical contact near a first end, a bottom plate area in a middle area, one or more burn out area(s) at said bottom plate area, and a second electrical contact extending from said bottom plate area, said first and second electrical contacts extending upwardly from the bottom plate are said electrical circuit being the only conductive path between an electrically dischargeable primer's cylindrical wall and an electrically dischargeable primer's cup or cap and said burnout area(s) having a total cross sectional area less than any other cross sectional area on said elongated conductive material.

6. The electrical circuit for an electrically dischargeable primer as set forth in claim 5 in which said elongated conductive material is formed from a conductive metal strip or foil, a conductive paint, or a conductive liquid which can be applied and dried within said electrically dischargeable primer.

7. An electrical circuit for an electrically dischargeable primer comprising:

a conductive material having one or more defined burn out area(s), each of said burn out area(s) having a cross sectional area, a total of all of said cross sectional area for all of said burnout area being smaller than any other cross sectional area on said conductive material;

a first electrical contact area extending from said burnout area, said first electrical contact area being electrically attachable to an inside surface of an electrically dischargeable primer's cylindrical wall; said first electrical contact extending upwardly from the burn out area(s); and a second electrical contact area extending from said burn out area(s), said burn out area(s) being between said first and second electrical contact area, said second electrical contact area being attachable to an inside bottom surface of an electrically dischargeable primer's cap or cup.

* * * * *